United States Patent [19]

Akagi et al.

[11] Patent Number: 4,728,564

[45] Date of Patent: Mar. 1, 1988

[54] SHEET-LIKE STRUCTURES AND PROCESS FOR PRODUCING THE SAME

[75] Inventors: Takao Akagi, Kurashiki; Itsuki Sakamoto, Hiroshima; Shinji Yamaguchi, Kurashiki, all of Japan

[73] Assignee: Kuraray Co., Ltd., Kurashiki, Japan

[21] Appl. No.: 815,623

[22] Filed: Jan. 2, 1986

[30] Foreign Application Priority Data

Feb. 5, 1985 [JP] Japan ..... 60-21350
Aug. 23, 1985 [JP] Japan ..... 60-186028

[51] Int. Cl.[4] ..... B32B 27/08; B32B 27/28; B32B 27/30; B32B 27/36

[52] U.S. Cl. ..... 428/247; 8/495; 428/252; 428/286; 428/336; 428/421; 428/423.7; 428/424.6; 428/425.5; 428/447; 428/451; 428/483

[58] Field of Search ..... 428/247, 91, 212, 336, 428/421, 252, 286, 483, 423.7, 424.6, 425.5, 447, 451; 8/495

[56] References Cited

U.S. PATENT DOCUMENTS

| | | | |
|---|---|---|---|
| 4,069,366 | 1/1978 | Hoey | 428/247 |
| 4,190,694 | 2/1980 | Muck et al. | 428/212 |
| 4,318,949 | 3/1982 | Okamoto et al. | 428/91 |

OTHER PUBLICATIONS

English translation of Japanese Laid-Open Patent No. 59-82469, May 12, 1984, pp. 1-9.

*Primary Examiner*—Thomas J. Herbert
*Attorney, Agent, or Firm*—Kramer, Brufsky & Cifelli

[57] ABSTRACT

A sheet-like structure comprises a fibrous structure containing not less than 10 weight percent of disperse dye-polyester fibers. At least one side of the structure is coated with a resin layer. A thin polymer film layer having a thickness of 100–10,000 angstroms is formed on at least one side of the resin layer. The structure is effective in preventing disperse dye migration and sublimation.

6 Claims, No Drawings

SHEET-LIKE STRUCTURES AND PROCESS FOR PRODUCING THE SAME

BACKGROUND OF THE INVENTION

1. Field of the Invention

This invention relates to resin-treated sheet-like structures in which a disperse dye-colored polyester fiber is used and to a process for producing the same. In particular, it relates to resin-treated sheet-like structures excellent in the effect of preventing migration and sublimation of said disperse dye and a process for producing the same.

2. Description of the Prior Art

Polyester fibers are fibers having distinct advantages of which the easy care property is a typical example. However, the number of those resin-finished products which are on the market and in which polyester fibers are used, such as water vapor-permeable, waterproof cloths, coated cloths and laminated cloths, is very small. Nylon fiber-made cloths constitute the mainstream in this field. The reason why polyester fibers are not used in the resin-finished products mentioned above is that when such products are made by using polyester fibers, the disperse dyes used for coloring the polyester fibers migrate through the resin layer and stain other textile fabrics during storage and sewing thereof and clothings during wearing thereof. This is presumably because polyester fibers do not form' chemical bonds with disperse dyes while nylon fibers are colored and chemically bound with ionic dyes. Furthermore, studies by the present inventors have revealed that disperse dyes are closer in solubility parameter to resins used in resin finish treatment, such as polyurethanes, polyacrylic esters and polyvinyl chloride, than to polyesters and thus have greater affinity for resin layers than for polyesters. This is also a reason for the migration of disperse dyes.

Several attempts have indeed been made to prevent migration and sublimation of disperse dyes. For instance, as described in Japanese Patent Publication Kokai No. 59-82469, (Publication Date-May 12, 1984)an attempt consists in providing fibrous structures with a monomeric melamine compound, causing crosslinking by heating to thereby form a layer scarcely permeable to dyes and thus decrease the rate of dispersion of dyes, and, thereafter, coating the structures with a polyurethane, for instance. However, the melamine compound-derived film renders fibrous structures hard in feel and touch and, in addition, shows poor adhesion to resin layers. Furthermore, said melamine compound-derived film has a solubility parameter of 8–9.5 $(cal/cm^3)^{\frac{1}{2}}$, which is almost equal to the solubility parameter of disperse dyes [8.3–9.7 $(cal/cm^3)^{\frac{1}{2}}$], so that said film is not so effective in preventing dye migration and sublimation.

It is also conceivable to provide fibrous structures with a silicone emulsion or a fluorine derivative emulsion. However, to cover the fiber surface completely is difficult and the products have little advantages. The effect of preventing dye migration and sublimation is small and the adhesion between the coat layer and the resin layer is very poor.

As disclosed in Japanese Patent Publication Kokai No. 58-214587 (Publication Date-Dec, 13,1983), for instance, it is further conceivable to subject fibrous structures first to resin treatment and then to film formation treatment. However, the film formation is very difficult to realize by the conventional processes. The reason is as follows: In the conventional resin treatment processes, solventbased film forming compositions are mainly used and therefore the resin-treated surface is generally hydrophilic, so that aqueous emulsions in general use are repelled and cannot form films. Even when the use of a solvent-based resin composition is considered for achieving adhesion of the resin to the hydrophilic surface, the solvent must not dissolve the resin layer already formed while, if the solvent cannot swell the resin at all, adequate adhesion cannot be obtained. The solvent selection is thus very difficult. Therefore, a special pretreatment step is required and this makes the whole process complicated, and the adhesion is still unsatisfactory.

In Japanese Patent Publication Kokai No. 53-16085 (Publication Date-Feb 14,1978) and Japanese Patent Publication Kokai No. 53-8669 (Publication Date-Jan. 26, 1978), it is disclosed that, for preventing plasticizers contained in polyvinyl chloride resins from bleeding out, the resin surface should be coated with a compact polymer formed upon contacting a gaseous fluorocarbon or a gaseous organosilicon compound with an inert gas plasma. It is thus known to form a plasma-polymerized film on the polyvinyl chloride surface by plasma polymerization using low temperature plasma discharge. However, this technique is nothing but a technique to prevent plasticizer bleeding.

Furthermore, in Japanese Patent Publication Kokai No. 60-119273 (Publication Date-June 26, 1985) filing laid open after filing of the instant application, there are described waterproof cloths and a process for producing the same which comprises causing a silane compound and/or a fluorine compound to adhere to a disperse dye-colored polyester-based cloth, causing crosslinking by means of a low temperature plasma and then coating the cloth surface with a resin.

In their study, which has led to the present invention, the present inventors checked this technique and found that said technique is still unsatisfactory in the effect of preventing migration of and staining with disperse dyes and further that the adhesion of resins for coating is poor.

The results obtained by the present inventors using the above technique are as follows:

At first, the present inventors, who found that crosslinking occurs on the fiber surface upon low temperature plasma treatment, subjected a disperse dye-colored polyester cloth to low temperature plasma treatment in argon, carbon monoxide, and so forth and then, after crosslinking on the surface of fibers occurring on the uppermost surface of the cloth, to coating treatment with a resin. With the cloth thus obtained, the effect of preventing dye migration could be seen to some extent when the coated cloth was in a dry condition whereas, when the coated cloth was immersed in water, then wrung to a certain moisture content and maintained in such wet condition, no migration preventing effect was observed at all. It was found that this is due to the fact that crosslinking occurs upon low temperature plasma treatment only on limited sites on the surface of fibers occurring on the uppermost surface of the cloth, so that dyes can migrate into the coating layer via uncrosslinked portions with the assistance of water which serves as a medium or vehicle when the test is carried out in a wet condition.

Then, the present inventors evaluated various compounds for adequacy of using them in causing them to adhere to polyester-based cloths, effecting crosslinking by means of a low temperature plasma and then carrying out resin coating treatment, as disclosed in the above-cited publication. While silicon compounds and fluorine compounds can be expected to be more or less effective in preventing dye migration even when such low temperature plasma treatment is omitted, it was found that when the cloths with said silicon compounds or fluorine compounds adhering thereto are coated with resins, the resin adhesion is very poor, uniform coating cannot be attained, the coats are readily peelable and the products therefore become valueless.

It was found that, in low temperature plasma treatment using silicon compounds or fluorine compounds, etching readily proceeds and effective crosslinking hardly proceeds although crosslinking may take place partly, and that, in testing in a wet condition, the effect of preventing dye migration is still poor because crosslinking sites are limited to the surface of fibers occurring on the uppermost cloth surface, although testing in a dry condition reveals a certain extent of effectiveness.

In both the above cases, uniform film formation on the fiber surface can be achieved only by increasing the amount of silicon compounds or fluorine compounds to a considerable level. In small amounts, the polyester fiber surface remains uncovered, so that no dye migration preventing effect can be produced. In large amounts, on the other hand, cloths become hard in feel and touch and at the same time the water vapor permeability required of the cloths is reduced. Furthermore, the low temperature plasma treatment itself cannot improve the adhesion between the plasma-treated surface and the resin for coating, so that nonuniform coating results and peeling readily occurs at the interface between the silicon or fluorine compound and the coating resin layer. Therefore, the products obtained are unsatisfactory ones.

SUMMARY OF THE INVENTION

The present inventors have found that the purpose of preventing migration and sublimation of disperse dyes in polyester fibers can be achieved very effectively by forming a film on the resin layer by plasma polymerization while employing the concept of "solubility parameter" and selecting an adequate range for the difference in solubility parameter between the disperse dyes and the film-forming compound.

Thus the invention is based on the finding that the prevention of disperse dye migration and sublimation can be achieved when a sheet-like structure produced by using disperse dye-colored polyester fibers and subjected to resin treatment on at least one side thereof is provided, at least on one side of the resin layer, with a thin polymer film by low temperature plasma polymerization using a monomer having a solubility parameter as small as possible and smaller than the solubility parameter of the disperse dye. Another finding is that when the monomer to be used has a smaller solubility parameter, a greater effect can be produced and that when the monomer has a smaller solubility parameter, the expected effect can be produced even if the thin film formed has a smaller thickness.

DETAILED DESCRIPTION OF THE INVENTION

The term "fibrous structure" as used herein means a woven or knitted fabric, a nonwoven fabric, or the like and of course includes fabrics or cloths of such kind which have been subjected to such treatment as primary antistatic finish, water repellent finish or water absorbent finish. Sometimes the fibrous structure is referred to herein also as "sheet-like structure".

The term "disperse dye" as used herein includes within the meaning thereof those dyes which belong to the category of disperse dyes as found in Colour Index published by The Society of Dyers and Colourists with acknowledgement to the American Association of Textile Chemists and Colorists for its contribution of technical information, including azo dyes, anthraquinone dyes, quinoline dyes, quinone dyes and phthalone dyes, among others. These dyes may be used either alone or in combination of two or more.

The term "polyester" as used herein includes polyesters synthesized from an aromatic dicarboxylic acid, such as terephthalic acid, phthalic acid, isophthalic acid or naphthaline-2,6-dicarboxylic acid, or an aliphatic dicarboxylic acid, such as adipic acid or sebacic acid, or an ester thereof and a diol compound, such as ethylene glycol, diethylene glycol, 1,4-butanediol, neopentyl glycol or cyclohexane-1,4-dimethanol. Particularly preferred among them are those polyesters such that ethylene terephthalate units account for at least 80 percent of their repeating structural units. The polyester further includes those based on the above-mentioned polyesters and modified by using, as comonomers, polyalkylene glycol, glycerol, pentaerythritol, methoxypolyalkylene glycol, bisphenol A, sulfoisophthalic acid and so forth. The polyesters may contain delustering agents, heat stabilizers, pigments, and so on. It is to be noted that usable species of the polyester are not limited to those mentioned above.

The term "polyester fiber or fibers" naturally includes both cut fibers and filaments and also includes conjugates of polyester fibers and other fibers, core-in-sheath fibers, multicore core-in-sheath fibers, and the like.

The sum up, any fibrous structure containing not less than 10 weight percent of disperse dye-colored polyester fibers can be treated in accordance with the invention. For attaining the polyester fiber content of not less than 10 weight percent, there may be used various techniques, for example filament combining, yarn blending, union cloth making and union knit making. At a content of less than 10 weight percent, the migration and sublimation of disperse dyes do not pose a serious problem. At polyester contents of not less than 10 weight percent, the effects of the invention are significant.

The term "resin treatment" includes those resin treatment processes in general use and the fibrous structure is subjected to resin treatment at least on one side thereof by such a technique as dip nip method, immersion method, dry or wet coating method, or lamination method.

The effects of the invention are particularly significant with fibrous structures coated or laminated with those resins which allow severe migration and sublimation of disperse dyes, such as polyurethanes, polyacrylic esters, polymethacrylic esters, styrene-butadiene and other rubber latices, polyvinyl acetate, chlorosulfonated polyethylene and polyvinyl chloride. This is presumably because these resins are close in solubility parameter (SP value) to disperse dyes. The resin treatment is not limited to resin treatment with only one resin but may use a resin mixture. Furthermore, it may be repeated two or more times and may also be combined with water repellent finish, antistatic finish or the like treatment. Any resin layer formed by such single or combined treatment as mentioned above is referred to herein as "resin layer". Thus, in some instances, the resin layer may be of the multilayer type. In this specification, however, these resin layers are each considered to be a monolayer.

The term "solubility parameter (or SP value)" means the value calculated on the basis of the structural formula by using the equation $SP = d\zeta G/M$ [(cal/cm$^3$)$^{\frac{1}{2}}$] where G is the group molar attraction constant as described in Polymer Handbook (edited by J. Brandrup and E. H. Immergut; John Wiley & Sons, Inc., N.Y.), page IV-339 $B_2$ or $B_1$ out of pages IV-337 to 359, M is the molecular weight and d is the density. The results of calculation of SP values for several typical substances are as follows: polyethylene terephthalate (10.7) (unit representation being omitted; the same shall apply hereinafter), polyurethane (8–10), polyacrylic acid butyl ester (8.5–9.5), polyvinyl chloride (9.5) and disperse dyes (8.3–9.7). When exact density values were unknown in calculating the above values, the value d=1 was used for convenience sake.

As seen in the above, disperse dyes are closer in SP value to polyurethanes, polyacrylic acid esters, polyvinyl chloride and the like than to polyesters and, for this reason, migrate to resin layers which are more compatible therewith.

The term "monomer or monomeric compound having an SP value smaller than the SP value of a disperse dye by at least 0.5" means a monomer or monomeric compound having an SP value smaller by at least 0.5 than the SP value of the disperse dye when only one dye is used or than the average SP value derived by summing up the respective products of the SP values of the respective dyes and the blending proportions of the respective dyes when two or more dyes are used in combination. When two or more dyes are used, the use of a monomer having an SP value smaller by at least 0.5 than the smallest SP value among the SP values of the dyes used can of course produce more significant migration and sublimation preventing effect. In case a monomer mixture is used, the average SP value for the constituent monomers as calculated in the same manner as in the case of mixed disperse dyes is to be used.

Examples of such monomer which may be either gaseous or liquid are aliphatic fluorocarbons (5.5–6.2), aromatic fluorocarbons (7.5–8.2), various silane coupling agents (4.7–8.4), saturated hydrocarbons (8 or less), unsaturated hydrocarbons (8 or less), ethers (8 or less), ammonia (16.3) and aliphatic lower alcohols (11–14.5).

Based on the results of investigations by the present inventors, fluorine- or silicon-containing monomers are preferred among the above-mentioned monomers from the effect viewpoint and fluorine-containing monomers are best preferred, although the reasons why they are more or most suited are not clear.

Among the fluorine-containing monomers, there may be mentioned various fluorine compounds, for example of the $C_nH_mCl_pF_{2n-m-p}$ type (n, m and p each being an integer and $n \geqq 2$, $m \geqq 0$, $p \geqq 0$ and $2n-m-p \geqq 1$), typically $C_2F_4$ and $C_3F_6$, of the $C_nHmCl_pBr_qF_{2n+2-m-p-q}$ (n, m, p and q each being an integer and $n \geqq 1$, $m \geqq 0$, $p \geqq 0$, $q \geqq 0$ and $2n+2-m-p-q \geqq 1$), typically $CF_4$, $C_2F_6$ and $C_3F_8$, of the cyclic $C_nH_mCl_pF_{2n-m-p}$ type (n, m and p each being an integer and $n \geqq 3$, $m \geqq 0$, $p \geqq 0$ and $2n-m-p \geqq 1$), typically $C_4F_8$, of the double bond-containing cyclic $C_nH_mCl_pF_{2n-2-m-p}$ type (n, m and p each being an integer and $n \geqq 4$, $m \geqq 0$, $p \geqq 0$ and $2n-2-m-p \geqq 1$), typically $C_4F_6$, of the type typified by $C_3F_6O$, and of the type typified by $NF_3$, $SF_6$ and $WF_6$.

Among the above examples, preferred from the commercial viewpoint are those with which the rate of film formation is great, such as $C_2F_4$, $C_3F_6$, $C_3F_8$, $C_4F_8$, $C_3F_6O$ and $C_2H_4F_2$. More preferred from the viewpoints of safety in transportation, rate of film formation and dye migration preventing effect, for instance, are $C_3F_6$, $C_4F_8$ and $C_3F_6O$.

Among these fluorine compounds, some are such that when used alone, they are low in film forming ability but, when they are used in admixture with a small amount of hydrogen gas or a nonpolymerizable gas, the rate of film formation is markedly increased. Typical examples with which an increased rate of film formation can be attained when they are used in admixture with hydrogen gas are $CF_4$, $C_2F_6$, $C_3F_8$ and $C_2H_4F_2$ and typical examples with which an increased rate of film formation can be attained when they are used in admixture with a nonpolymerizable gas are $C_2F_4$, $C_3F_6$, $C_4F_8$ and $C_3F_6O$.

Examples of the nonpolymerizable gas which can be highly effective are inert gases, in particular argon gas. The fluorine compounds may contain such atoms as hydrogen, chlorine and/or bromine but these atoms cannot be considered to be very effective from the viewpoint of dye migration and sublimation prevention.

As examples of the silicon-containing monomer, thee may be mentioned various silane coupling agents.

Using the monomers mentioned above, a plasma-polymerized thin film layer having a thickness of 100–10,000 angstroms is formed on at least one side of the resin layer provided on at least one side of the fibrous structure. The sheet-like structure obtained by the above-mentioned series of operations is composed of at least three layers and is a quite novel structure. The thin film having a thickness of 100–10,000 angstrome, as obtainable only by the plasma polymerization process, does not impair the feel and touch or appearance of the resulting structure.

Thus, in accordance with the invention, the dye migration and sublimation can be prevented by the presence of the above-mentioned thin film which does not impair the feel or appearance. The practical value of the invention is therefore very great. Another favorable advantage obtainable in accordance with the invention is that the water resistance and water repellency of the sheet-like structure may sometimes be improved while the water vapor permeability and air permeability are maintained in a satisfactory manner without decreasing them. It is an unexpected, novel effect producible in accordance with the invention that when the coating layer is the so-called water vapor-permeable and air-permeable coating layer having a great number of minute pores, the original water vapor permeability and air permeability are not reduced even after formation of the plasma-polymerized film in accordance with the invention. It has been confirmed by observations under an electron microscope that after polymer film formation on the microporous coating layer in accordance with the invention, there remain the original micropores as such without being covered by the polymer film.

The fact that such thin film can prevent the migration and sublimation of disperse dyes is indicative of uniformity in plasma-polymerized film thickness and absence of specks. While the adhesion between such film and the resin layer is very poor in the conventional processes, the adhesion attainable by the plasma polymerization process according to the invention is very good.

When the film thickness exceeds 10,000 angstroms, there appears a tendency toward harder feel and touch. On the other hand, when the thickness is smaller than 100 angstroms, the effect of preventing dye migration and sublimation may be impaired readily on the sites where the film is broken as a result of friction, rubbing, or the like. Thus, the film thickness is preferably within the range of 100–10,000 angstroms, more preferably within the range of 500–3,000 angstroms.

When the relation $y > -x + 1{,}400$, where x is the hydrostatic pressure resistance (in mm) of the sheet-like structure and y is the water vapor permeability (in $g/m^2/24$ hr) of the same, is satisfied, said sheet-like structure becomes a structure having water-proofing and water vapor permeation functions together with good water resistance, water repellency, air permeability and water vapor permeability. When the film thickness exceeds 10,000 angstroms, the water vapor permeability decreases and there is seen a tendency such that the above condition is unsatisfied, although the water resistance increases. When the film thickness is below 100 angstroms, the water resistance improving effect is somewhat smaller.

The monomer introduced into the system for forming a thin film by polymerization induced in a low temperature plasma is excited to some or other level and decomposed and induces polymerization reactions, whereby main chains, branched structures and crosslinked structures are formed. In these reactions, elimination or removal of a monomer-constituting element from the monomer supposedly plays an important role.

When a fluorine-containing monomer is used, for instance, the activated carbon resulting from fluorine atom elimination reacts with oxygen as a result of trapping air remaining within the system or contacting with air on the occasion of taking the product out of the system after polymerization. Therefore it is readily assumable that the thin film synthesized from a fluorine-containing monomer in a low temperature plasma must contain oxygen.

This respect was investigated by the present inventors using X-ray photoelectron spectroscopy (hereinafter abbreviated as "XPS").

The present inventors found that when the ratios F/C and O/C as found by XPS analysis are within certain respective specific ranges, the plasma-polymerized thin film is very excellent in the effect of preventing disperse dye migration and sublimation.

Thus, it was found that when the degree of fluorination, $\alpha$ (=F/C), of the polymerized film is within the range of $0.2 \leqq \alpha \leqq 1.8$, said film is excellent in the effect of preventing disperse dye migration and sublimation and further that when the degree of fluorination $\alpha$ is within the range of $0.2 \leqq \alpha \leqq 1.3$ and the degree of oxygenation, ($\beta$(=O/C) is within the range of $0.05 < \beta \leqq 0.35$, the effect is still more significant.

Said degree of fluorination $\alpha$ is the quotient obtained by dividing the number of fluorine atoms as calculated from the fluorine $F_{1S}$ peak area measured by XPS by the number of carbon $C_{1S}$ atoms as calculated in the same manner and said degree of oxygenation $\beta$ is the quotient obtained by dividing the number of oxygen atoms as calculated from the oxygen $O_{1S}$ peak area measured by XPS by the number of carbon atoms as calculated in the same manner.

When $\alpha$(=F/C) of the thin film as determined by XPS analysis is smaller than 0.2, the effect of preventing disperse dye migration and sublimation is markedly low due to insufficiency in the absolute quantity of fluorine. In this case, $\beta$(=O/C) becomes greater than 0.35. Thus, a large portion of fluorine is eliminated from the thin film and the film assumes a highly branched and crosslinked structure and takes up a large quantity of oxygen and, as a result, the effect of preventing disperse dye migration and sublimation can be produced only to a negligible extent.

When $\alpha$ of the thin film as determined by XPS analysis exceeds 1.8, the polymer formed is expected to be close to polytetrafluoroethylene (Teflon) (XPS analysis of Teflon gave the result F/C = 1.86) and to be a linear polymer almost free from branching and crosslinking. The effect of preventing disperse dye migration and sublimation is poor presumably due to scarcity of crosslinked structures.

In the above case, $\beta$(=O/C) becomes less than 0.05. This suggests that the quantity of activated carbon in the plasma polymerization system is extremely small. In fact, it is difficult to obtain such thin film without using a special apparatus and carrying out the treatment for a prolonged period of time. Thus it is necessary that $\alpha$ is within the range of $0.2 \leqq \alpha \leqq 1\ 8$.

When the thin film formation speed (cost-performance) and the performance characteristics of the thin film are taken into consideration, it is more preferable that the $\alpha$ and $\beta$ values of the thin film are within the ranges $0.2 \leqq \alpha = F/C \leqq 1.3$ and $0.05 < \beta = O/C \leqq 0.35$, respectively. In that case, sheet-like structures still more excellent in the effect of preventing disperse dye migration and sublimation can be obtained.

As a result of detailed XPS analysis of those thin films which are effective in preventing dye migration and sublimation, the present inventors found that the thin films should desirably meet the conditions $10\% < A < 70\%$, $10\% < B < 35\%$, $10\% < C < 35\%$, $5\% > D < 30\%$ and $0\% < E < 20\%$ and that more desirably, they should meet the conditions $(B+8)\% > (C+3)\% > D\% > E\%$ and $B\% > (E+6)\%$ as well as the above conditions.

In the above, A, B, C, D and E are the percentage values derived by performing a procedure of separating the carbon $C_{1S}$ chart obtained by XPS analysis of the thin film into several wave forms each centering around a bond energy corresponding to a peak on said chart (wave-form separation procedure), dividing the areas of said wave forms by the total $C_{1S}$ area and multiplying the values thus obtained by 100, A being such percentage value for the wave form having a peak around 285 electron volts (eV), B for the wave form having a peak around $287 \pm 0.5$ eV, C for the wave form having a peak around $289 \pm 0.5$ eV, D for the wave form having a peak around $291.6 \pm 0.5$ eV and E for the wave form having a peak around $293.8 \pm 0.5$ eV. For conventional Teflon films, it was found that A = 19.3% and D = 80.7%.

The value A may be considered to be the proportion representative of fluorine-free carbon atoms, B to be the proportion representative of carbon atoms each adjacent to a fluorine-bearing carbon atom, C to be the proportion representative of fluorine-bearing carbon atoms each adjacent to a fluorine-bearing carbon atom, D to be the proportion representative of carbon atoms each bearing two fluorine atoms, and E to be the proportion representative of carbon atoms each bearing three fluorine atoms.

For determining the ratios F/C and O/C by XPS, Shimadzu Corporation's ESCA model 750 apparatus was used and for analysis, Shimadzu Corporation's ESPAC model 100 was used.

Specimens, 6 mm in diameter, were prepared by punching, and each specimen was stuck to a specimen holder with an adhesive tape bearing an adhesive on both sides thereof and submitted to analysis. As the radiation source, there was used the MgK$\alpha$ ray (1,253.6 eV). The vacuum within the apparatus was $10^{-7}$ Torr.

Measurement was made for $C_{1S}$, $F_{1S}$ and $O_{1S}$ peaks. Each peak was corrected and analyzed using the ESPAC model 100 analyzer (by the correction method proposed by J. H. Scofield) and each peak area was determined. Each $C_{1S}$ area was multiplied by the relative intensity factor 1.00, each $O_{1S}$ area by 2.85 and each $F_{1S}$ area by 4.26. The surface atom number ratios (fluorine/carbon and oxygen/carbon) were directly calculated in terms of percentage from the area values thus obtained.

The charge corrections were made based on the Au47/2 spectrum (83.8 eV) of a gold film vapor-deposited on the specimen.

The term "low temperature plasma polymerization (treatment)" as used herein means the polymerization technique using low temperature plasma discharge. The following three processes are typical examples of such technique.

Process A

Process comprising subjecting a resin-treated fibrous structure to one-step polymerization treatment in the presence or absence of a nonpolymerizable gas (plasma polymerization process);

Process B

Process comprising exposing a resin-treated fibrous structure to low temperature plasma discharge for radical formation in the presence of a nonpolymerizable gas and introducing the structure into an atmosphere containing at least one polymerizable monomer to thereby effecting polymerization while avoiding contact with oxygen as far as possible (two-step grafting process);

Process C

Process comprising exposing a resin-treated fibrous structure to low temperature plasma discharge for radical formation in the presence of an oxygen gas or a nonpolymerizable gas, converting the radicals to peroxides by exposing the structure to an oxygen-containing atmosphere and then introducing the structure into an atmosphere containing at least one polymerizable monomer to thereby effect polymerization (peroxide process). The "low temperature plasma" is characterized in that the plasma formed in an electric discharge has an average electron energy of 10 eV ($10^4$–$10^5$ K) and an electron density of $10^9$–$10^{12}$ $cm^{-3}$. It is also called "unequibrated plasma" since the electron temperature and gas temperature are not in an equilibrium. In the plasma formed in a discharge, there exist electrons, ions, atoms, molecules, and so on simultaneously.

As the power source for applying a voltage, there may be used any power source of any frequency. From the sustained and uniform discharge viewpoint, a frequency of 1 KHz to 10 GHz is preferred. From the viewpoint of plasma uniformity in the direction of the breadth of the electrodes, a frequency of 1 KHz to MHz is preferred. At a frequency above 1 MHz, treatment specks are readily formed in the lengthwise direction when the electrode length exceeds 1 meter. At a frequency below 100 Hz, the electrode edge effect is readily produced, namely arc discharge readily takes place at edge portions. As the electric current, there may be used, for instance, alternating current, direct current, biased alternating current and pulsating current. The electrode system includes the internal electrode system in which the electrodes are placed in the vacuum system and the external electrode system in which the electrodes are placed outside of the vacuum system. When the apparatus is large-sized, the external electrode system is not very effective in performing the intended treatment especially because the plasma loses its activity during transfer to the surface of the fibrous structure to be treated or the plasma is scattered and thereby the plasma concentration is diluted. On the other hand, the internal electrode system is much more effective in performing the treatment as compared with the external electrode system because it is possible to dispose the discharge electrodes in the neighborhood of the fibrous structure to be treated.

In shape, the electrodes may be either symmetrical or unsymmetrical. In the case of a large-sized plasma treatment apparatus in which wide fibrous structures are to be treated and for which large electrodes are required, symmetrical electrodes are fairly disadvantageous. For instance, it is almost impossible to cause a gas to flow uniformly between large electrodes. The electric field is disturbed at the end portions of the electrodes when they are large, whereby treatment specks are readily formed. In the case of large plasma treatment apparatus, unsymmetrical electrodes are therefore preferred. The fibrous structure to be treated may be set at an arbitrarily selected position between the electrodes for transfer. In some instances, positioning in contact with one electrode can result in little wrinkle formation and great treatment effects.

The shape of the electrode not in contact with the fibrous structure to be treated may be cylindrical or rod-like with an acute angle-containing polygonal cross-section, for instance. One or more such electrodes may be used. The effect of treatment depends also on the number of electrodes. When the number of electrodes is too small, the treatment effect is small. As for the shape, cylindrical electrodes are preferred. The electrode which may come into contact with the fibrous structure to be treated may have a drum-like or plate-like shape, or some other modification thereof, for instance. The electrode shape and combination are, however, not limited to the examples given hereinabove. The electrodes may be made of a metal such as stainless steel, copper, iron or aluminum and may be coated with glass, ceramic or the like as necessary. These electrodes may naturally be cooled with water as necessary and the cooling temperature is suitably selected depending on the fibrous structure to be treated. The cooling water should desirably be as impurity-free as possible. In cases where electric leak loss due to impurities is not a substantial problem, however, the impurity content is not critical.

The gas to be introduced into the vacuum system should be introduced into said system through an inlet located as far from the exit as possible by means of a vacuum pump, if necessary dividedly. The gas may also be introduced into said system at a site between the electrodes. This is important for avoiding short pass of the gas within the vacuum system and at the same time for preventing formation of treatment specks on the fibrous structure to be treated.

The monomer-containing gas to be introduced into the vacuum system may be a monomer gas, a mixture of the monomer and a nonpolymerizable gas, or a mixture of the monomer gas and a polymerizable gas. The monomer gas may be one already in the gaseous state at ordinary temperature or one which is in the liquid state at ordinary temperature. The proportion between the nonpolymerizable gas or polymerizable gas and the monomer gas can be selected in an arbitrary manner depending on the reactivity of the monomer gas, the performance characteristics of the thin film formed and other factors. Two or more monomer gases or a monomer gas and other gas or gases, for instance, may be introduced into the vacuum system either separately for blending within the system or simultaneously in the form of a mixture prepared in advance. It is also possible to introduce the monomer gas while maintaining electric discharge within a nonpolymerizable gas.

The vacuum (absolute pressure) for low temperature plasma formation is generally within the range of 0.001–50 Torr. On the basis of the study results obtained by the present inventors, however, a vacuum of 0.01–5.0 Torr should desirably be used. When the vacuum is below 0.01 Torr, the mean free paths of ions and electrons increase and the accelerated particles acquire more energy but the total number of accelerated particles arriving at the fibrous structure to be treated decreases. As a result, the treatment efficiency is somewhat lowered. Moreover, for maintaining a large-sized treatment chamber at a vacuum lower than 0.01 Torr while introducing a gas thereinto, there is required a vacuum pump having a very great displacement capacity, which is not desirable also from the cost of equipment viewpoint. At a vacuum of more than 5 Torr, the mean free paths for ions, electrons and so on become shortened, the energies of accelerated particles decrease and, as a result, the treatment efficiency decreases in spite of the fact that the total number of accelerated particles is great.

The relative positioning of the sheet-like structure between the electrodes has been mentioned hereinabove. Generally, the treatment efficiency is better when said structure is placed in contact with one electrode. When the structure should desirably be kept free from a substantial tension or when wrinkle formation on the structure should be avoided, an apparatus in which the structure and the electrodes can move together, for example an apparatus in which the structure is placed in contact with a drum electrode and moved while rotating the drum, is preferred. Minute wrinkles in fact often cause formation of treatment specks. When little care is required to be given to the tension or wrinkle aspect, the structure may be placed on a plate electrode in contact therewith and transported in a sliding manner on said electrode. It is of course possible to treat both sides of the structure by passing the structure, after one-side treatment, through a space where another pair of electrodes is reversedly positioned relative to the structure. In general cases, one-side treatment is mostly sufficient and this type of treatment is desirable also from the treatment efficiency viewpoint. If, however, the both-side treatment effect is to be attained at any cost with only one pair of electrodes, the object can be accomplished by inserting the sheet-like structure between both the electrodes at an intermediate position therebetween and cause the structure to move in parallel with the electrodes. In this case, the effect of treatment is generally small as compared with the case in which the structure is positioned in contact with one electrode. When considered from the discharge characteristic viewpoint, this phenomenon can be interpreted in terms of the characteristic of voltage drop between both the electrodes. The interelectrode voltage drop characteristic is said to be such that the voltage drop is sharpest in the neighborhood of the lower voltage side electrode and next sharpest on the higher voltage side while the voltage drop is moderate in the region about halfway between both the electrodes. This voltage drop is directly proportional to the electric field intensity. Where the voltage drop is greater, charged particles can acquire more energy. This is presumably the cause of the above phenomenon. In the case of direct current systems, the lower voltage side electrode and the higher voltage side electrode can easily be discriminated from each other. On the contrary, in the case of alternating current systems, it is impossible to say which is the lower voltage side electrode and which is the higher voltage side electrode since the lower voltage side and higher voltage side interchange repeatedly with time. In any case, however, it is believable that the voltage drop is greater and the effect of treatment is greater at a place closer to an electrode.

From the uniform treatment viewpoint, it is necessary to hold both the electrodes in parallel with each other and, moreover, the electrodes must be perpendicular to the fibrous structure to be treated. Failure in meeting these requirements results in treatment speck formation in the breadth direction of the structure.

Furthermore, it is necessary that both the electrodes should have a breadth greater by at least 5 cm than the breadth of the fibrous structure to be treated so that the lack of uniformity of the electric field appearing at the terminal portions of the electrodes can be prevented from influencing the treatment. When the breadth difference is smaller than 5 cm, the effect of treatment differs in the direction of the breadth of the structure, in particular the treatment effect on either side unfavorably differs from that attained in the middle of the structure.

The process according to the invention can be carried out in any appropriate apparatus, for example an air-to-air apparatus for continuous operation, in which the sheet-like structure is continuously introduced into the vacuum system for treatment from the ambient air atmosphere, an apparatus for semicontinuous operation, in which the sheet-like structure is placed in a preliminary vacuum system and then transferred therefrom to the treatment chamber, or an apparatus for batchwise operation, in which a plurality of sheet-like structures are placed in compartments within the treatment chamber and, after treatment within said chamber, taken out of the chamber.

The output of discharge plasma is desirably such that the output acting on the discharge region amounts to 0.1–5 watts/cm$^2$. In this case, it suffices that either the value obtained by dividing the plasma discharge output by the area of that portion of the sheet-like structure which is in the discharge or the value obtained by dividing said output by the surface area of either of the paired electrodes is within the range of 0.1–5 watts/cm$^2$. While the discharge output can be calculated easily when the discharge voltage and current are measured, the discharge output may be estimated at 30–70 percent of the plasma power source output. When the output of discharge plasma is lower than 0.1 watt/cm$^2$, much time is required for completing the plasma polymerization treatment and the polymer film obtained has an insufficient thickness. When the output of discharge plasma exceeds 5 watts/cm$^2$, the discharge becomes somewhat unstable and etching may easily take place in addition to polymerization. From the viewpoint of long-term stable discharge for plasma polymerization, the output of discharge plasma is most preferably within the range of 0.1 watt/cm$^2$ to 2 watts/cm$^2$.

The treatment period is preferably within the range of about 5–600 seconds but is not always limited thereto. When the treatment period is shorter than 5 seconds, the thickness of the polymer film formed is rather small. When said period is longer than 600 seconds, the change of the performance characteristics of fibers occurs. For example shade change occurs, the surface becomes hard to a certain extent or the structure becomes brittle, although the polymer film thickness is sufficient.

The thickness of each thin film formed by the process mentioned above was determined with a multiple interference microscope or an electron microscope. As a result, it was found that the migration and sublimation of dyes can be completely inhibited when a monomer having an average SP value smaller by at least 0.5 than the average SP value of the disperse dyes and when the thin film has a thickness of 100–10,000 angstroms. When the thin film thickness is below 100 angstroms, the film is rather poor in abrasion resistance although some effect can be still produced. For attaining satisfactory durability, the film thickness should preferably be not less than 500 angstroms. In some instances, however, a thickness of 100 angstroms is sufficient for providing satisfactory durability if the monomer and resin are appropriate.

The term "ungrounded electrodes" as used herein refers to the state in which the discharge electrodes and discharge circuit are electrically isolated from the grounded can body, so that they are in an ungrounded state. In such case, the electric potential of the electrode in contact with the sheet-like structure is different from the electric potential of the can body (which is grounded and therefore at the ground potential), the can body does not act as an electrode, and the discharge takes place mainly between both the electrodes. Therefore, the plasma can act on the sheet-like structure efficiently without dilution, so that the treatment effect is markedly improved. At the same time, the treatment effect which can be produced with a smaller quantity of electric energy for discharge is much greater as compared with the conventional grounded system. Since the contemplated effect can thus be obtained in a short period of time, the apparatus may be of a small size, hence the cost of equipment can be reduced. Furthermore, the process requires only a small quantity of electric energy for discharge, so that the running cost can be reduced to fractions of that incurred in the prior art.

The following examples are further illustrative of the present invention. The water repellency, hydrostatic pressure resistance, air permeability and water vapor permeability measurements were conducted by the methods described in JIS (Japanese Industrial Standard) L-1092 (spray method), JIS L-1092 (method A), JIS L-1096 Method A (Frazier method) and JIS Z-0208, respectively. For durability or fastness evaluation, washing was repeated ten times by the JIS L-0217-103 method. The migration and sublimation were evaluated by putting, between two stainless steel sheets, the sample cloth and resin-finished white cloth of the same kind as the sample, with the plasma polymerization face of the former in intimate contact with the resin-treated face of the latter, allowing them to stand under a load of 100 g/cm$^2$ in an atmosphere of 120° C. for 80 minutes and determining the degree of staining of the white cloth on the gray scale. The stain measurement was performed in a dry condition as well as in a wet condition. The plasma equipment used in the examples was of the bell jar type and a high frequency wave of 500 KHz was employed as the power source. The electrodes used were symmetric disk electrodes. In the tables appearing later herein, the polymerization processes A, B and C respectively correspond to the plasma polymerization processes A, B and C mentioned hereinabove, the process A being generally called "plasma polymerization process", the process B "two-step grafting process" and the process C "peroxide process".

For the monomers, the following abbreviations are used: $C_2F_4$ for tetrafluoroethylene, TMCS for trimethylchlorosilane, VDEMS for vinyldiethylmethylsilane, $CH_4$ for methane, VTAS for vinyltriaceoxysilane and $NH_3$ for ammonia.

As for the nonpolymerizable gases, Ar stands for argon, $O_2$ for oxygen and $H_2$ for hydrogen. The durability was evaluated as "O" when not less than 90 percent of the initial performance was retained after 10 repetitions of washing.

In the examples and comparative examples in each of series A and series B, the coating treatment was performed under the following conditions:

| Resin used for coating | Treatment bath composition | | Treatment conditions |
|---|---|---|---|
| Polyurethane | Polyurethane*1 | 30 parts | Coating: with a comma coater |
| | Dimethylformamide | 70 parts | Coagulation: by wet method |
| | | | Heat treatment: |
| | | | Drying at 120° C. |
| | | | Setting at 150° C. |
| Acrylic resin | Polyacrylate*2 | 20 parts | Coating: with a knife coater |
| | Toluene | 80 parts | Heat treatment: |
| | | | Drying at 120° C. |
| Polyvinyl chloride | PVC | 100 parts | Coating: by direct rolling |
| | Plasticizer (DOP) | 80 parts | Heat treatment: |
| | Stabilizer | 5 parts | Drying at 130° C. |

-continued

| Resin used for coating | Treatment bath composition | | Treatment conditions |
|---|---|---|---|
| | Trichloroethylene | 10 parts | Setting at 180° C. |

Notes:
*1CRYSBON 8166 (trademark of Dainippon Ink and Chemicals, Inc.)
*2CRYSBON P1130 (trademark of Dainippon Ink and Chemicals, Inc.)

EXAMPLES AND COMPARATIVE EXAMPLES IN SERIES A

In comparative Example 1 and Examples 1–12, a drawn semidull polyethylene terephthalate yarn of 50 denier, 36 filaments, were prepared as warps and a drawn polyethylene terephthalate yarn of 75 denier, 36 filaments, as wefts in the conventional manner, and a plain wave fabric was produced therefrom and, after treatment in the conventional manner, colored with a red disperse dye. Thereafter, the fabric was subjected to resin treatment with the polyurethane by the wet process, followed by plasma polymerization treatment under various sets of conditions as specified in Table 1.

In Comparative Example 1, the disperse dye migration and sublimation were evaluated as class 2 or 3 by the dry method and as class 2 by the wet method, the water vapor permeability was 4,500 g/m$^2$/24 hr, the resistance to hydrostatic pressure was not less than 3,000 mm, and the water repellency was 80 points. In each of Examples 1–12, marked improvements were produced in the classification evaluation of disperse dye migration and sublimation whereas no impairment was caused in the water vapor permeability. Slight improvements were produced also in the water repellency and the durability was retained.

In Example 7, in which argon, a nonpolymerizable gas, was added in a small amount to the gas used in Example 4 (gaseous $C_4F_8$ was fed to make 0.3 Torr and argon additionally in a small amount to make 0.35 Torr), and in Example 8, in which hydrogen, a polymerizable gas, was added in a small amount to the $C_3F_8$ gas used in Example 3 (gaseous $C_3F_8$ was fed to make 0.3 Torr and hydrogen additionally to make 0.35 Torr), greater film thicknesses were obtained as compared with Example 4 and 3, respectively.

In Example 11, in which the sample-bearing electrode side as used in Example 2 was electrically connected with the vacuum can body to attain grounding, the film thickness was smaller as compared with Example 2 and the film formation rate was believed to be slow and the electric efficiency to be low.

In Example 12, the film thickness was as small as 200 angstroms and the effect of preventing disperse dye migration and sublimation was somewhat smaller.

In Comparative Example 2, the colored fabric as used in Comparative Example 1 was subjected to acrylic resin coating in lieu of polyurethane coating. In Examples 13–17, a thin film was formed on the acrylic coat of Comparative Example 2 by plasma polymerization. In the case of acrylic coating, too, marked improvements were attained in the classification evaluation of disperse dye migration and sublimation and slight improvements also in the hydrostatic pressure resistance and water repellency were attained. The water vapor permeability was retained and the durability was good in each of Examples 13–17.

In Comparative Example 3, the colored fabric as used in Comparative Example 1 was coated with polyvinyl chloride in place of the polyurethane and, in Example 18, the fabric of Comparative Example 3 was subjected to plasma polymerization treatment. In the case of polyvinyl chloride coating, too, the effect of preventing disperse dye migration and sublimation was obviously produced.

In Comparative Example 4, the taffeta used in Comparative Example 1 was colored with a mixed disperse dye (a 1:1 mixture of a disperse dye having an SP value of 8.3 and one having an SP value of 8.1) and provided with a polyurethane coat. In Comparative Example 5, in which the fabric of Comparative Example 4 was subjected to plasma polymerization treatment using gaseous $CF_4$, the single use of $CH_4$ resulted in little film formation, so that no substantial film thickness could be observed. Accordingly, the effect of preventing disperse dye migration and sublimation was little.

In Examples 19–23, the sample of Comparative Example 4 was subjected to plasma polymerization treatment under various conditions. In Example 19, in which gaseous $C_2H_4F_2$ was mixed with hydrogen, a markedly increased film thickness was obtained as compared with Example 6 in which no hydrogen was admixed. In Example 20, in which a small amount of hydrogen was incorporated at the process of Comparative Example 5, the admixture of hydrogen caused film formation in spite of no film formation resulting from the single use of $CF_4$. In this example, the effect of preventing disperse dye migration and sublimation was expressly produced as well. In the case of hydrogen addition, however, failure to adequately control the quantity of hydrogen easily leads to such a problem as coloration of the film in case of excessive feeding of hydrogen. The results of Examples 21–23 revealed that those fluorine compounds which contain hydrogen, chlorine and/or bromine atoms are also effectively usable to produce the effect of preventing disperse dye migration and sublimation.

In Comparative Example 6, a taffeta produced by using a polyester-cotton blend spun yarn was colored with a disperse dye having an SP value of 9.1 and further colored on the cotton side by a conventional method of dyeing cotton and, then, coated with the polyurethane by the dry method. In Example 24, the sample of Comparative Example 6 was subjected to plasma polymerization treatment. In this case, too, the disperse dye migration and sublimation preventing effect was produced. For typical examples, the values of $\alpha$, $\beta$, A, B, C, D and E are given in Table 1. In all the examples according to the invention, the following conditions, which are recited in the accompanying claims, were successfully met: $10\% < A < 70\%$, $10\% < B < 35\%$, $10\% < C < 35\%$, $5\% < D < 30\%$ and $0\% < E < 20\%$; or $(B+8)\% > (C+3)\% > d\% > E\%$ and $B\% > (E+6)\%$.

The products of the examples according to the invention also met the relation $Y > -x + 1{,}400$.

TABLE 1-1

| No. | Fibrous structure | Polyester content % | Average SP value of disperse dye | Resin finish | Plasma polymerization conditions: Polymerization process | Electrode system | Monomer: Monomer | Average SP Value |
|---|---|---|---|---|---|---|---|---|
| Compar. Ex. 1 | Polyester taffeta | 100 | 9.4 | Polyurethane coating | | | | |
| Ex. 1 | Polyester taffeta | " | " | Polyurethane coating | Process A | Not grounded | $C_2F_4$ | 3.3 |
| Ex. 2 | Polyester taffeta | " | " | Polyurethane coating | Process A | Not grounded | $C_3F_6$ | 3.8 |
| Ex. 3 | Polyester taffeta | " | " | Polyurethane coating | Process A | Not grounded | $C_3F_8$ | 2.3 |
| Ex. 4 | Polyester taffeta | " | " | Polyurethane coating | Process A | Not grounded | $C_4F_8$ | 2.3 |
| Ex. 5 | Polyester taffeta | " | " | Polyurethane coating | Process A | Not grounded | $C_3F_6O$ | 3.1 |
| Ex. 6 | Polyester taffeta | " | " | Polyurethane coating | Process A | Not grounded | $C_2H_4F_2$ | 4.8 |
| Ex. 7 | Polyester taffeta | " | " | Polyurethane coating | Process A | Not grounded | $C_4F_8$ | 2.3 |
| Ex. 8 | Polyester taffeta | " | " | Polyurethane coating | Process A | Not grounded | $C_3F_8$ | 2.3 |
| Ex. 9 | Polyester taffeta | " | " | Polyurethane coating | Process A | Not grounded | $C_3F_6$ | 3.8 |
| Ex. 10 | Polyester taffeta | " | " | Polyurethane coating | Process A | Not grounded | $C_3F_6$ | 3.8 |
| Ex. 11 | Polyester taffeta | " | " | Polyurethane coating | Process A | Grounded | $C_3F_6$ | 2.3 |
| Ex. 12 | Polyester taffeta | " | " | Polyurethane coating | Process A | Not grounded | $C_4F_8$ | 2.3 |
| Ex. 13 | Polyester taffeta | " | " | Acrylic coating | Process A | Not grounded | $C_4F_8$ | 2.3 |
| Ex. 14 | Polyester taffeta | " | " | Acrylic coating | Process A | Not grounded | $C_4F_8$ | 2.3 |

| No. | Plasma polymerization conditions: Nonpolymerizable gas | Vacuum Torr | Output W/cm² | Time Sec. | Film thickness Å | XPS analysis data: α | β | A % | B % | C % | D % | E % |
|---|---|---|---|---|---|---|---|---|---|---|---|---|
| Compar. Ex. 1 | | | | | | | | | | | | |
| Ex. 1 | | 0.3 | 1 | 180 | 1100 | 1.15 | 0.10 | 19 | 24 | 24 | 18 | 15 |
| Ex. 2 | | " | " | " | 1050 | 1.05 | 0.12 | 14 | 29 | 22 | 24 | 11 |
| Ex. 3 | | " | " | " | 400 | 1.15 | 0.15 | 26 | 18 | 22 | 21 | 13 |
| Ex. 4 | | " | " | " | 1100 | 0.99 | 0.13 | 20 | 28 | 23 | 18 | 10 |
| Ex. 5 | | " | " | " | 1200 | 1.07 | 0.11 | 17 | 28 | 21 | 21 | 13 |
| Ex. 6 | | " | " | " | 350 | | | | | | | |
| Ex. 7 | Ar | 0.35 | 1 | " | 1400 | | | | | | | |
| Ex. 8 | $H_2$ | 0.35 | 1 | " | 1000 | | | | | | | |
| Ex. 9 | | 0.3 | 2 | 180 | 2700 | 1.21 | 0.09 | 17 | 24 | 24 | 19 | 16 |
| Ex. 10 | | 0.3 | 2 | 60 | 900 | 1.05 | 0.14 | 16 | 29 | 21 | 23 | 16 |
| Ex. 11 | | 0.3 | 1 | 180 | 450 | | | | | | | |
| Ex. 12 | | 0.3 | 1 | 20 | 200 | | | | | | | |
| Ex. 13 | | 0.3 | 1 | 180 | 1100 | 0.99 | 0.13 | 20 | 28 | 23 | 18 | 10 |
| Ex. 14 | | 0.3 | 2 | 180 | 2300 | 0.32 | 0.29 | 55 | 17 | 17 | 8 | 3 |

TABLE 1-2

| No. | Dye migration and sublimation Dry/Wet | Water vapor permeability g/m²/24 hr | Resistance to hydrostatic pressure mm | Water repellency points | Durability |
|---|---|---|---|---|---|
| Compar. Ex. 1 | 2-3/2 | 4500 | ≧3000 | 80 | 0 |
| Ex. 1 | 5/4-5 | 4450 | " | 90 | 0 |
| Ex. 2 | 5/4-5 | 4440 | " | " | 0 |
| Ex. 3 | 4/4 | 4480 | " | 85 | 0 |

TABLE 1-2-continued

| No. | Dye migration and sublimation Dry/Wet | Water vapor permeability $g/m^2/24$ hr | Resistance to hydrostatic pressure mm | Water repellency points | Durability |
|---|---|---|---|---|---|
| Ex. 4 | 5/4-5 | 4450 | " | 90 | 0 |
| Ex. 5 | 5/5 | 4440 | " | 90 | 0 |
| Ex. 6 | 4/4 | 4500 | " | 85 | 0 |
| Ex. 7 | 5/4-5 | 4400 | " | 90 | 0 |
| Ex. 8 | 5/4-5 | 4450 | " | 90 | 0 |
| Ex. 9 | 5/5 | 4300 | " | 100 | 0 |
| Ex. 10 | 4-5/4-5 | 4450 | " | 90 | 0 |
| Ex. 11 | 4/4 | 4480 | " | 85 | 0 |
| Ex. 12 | 3-4/3-4 | 4500 | " | 80 | 0 |
| Ex. 13 | 5/4-5 | 2050 | 1500 | 90 | 0 |
| Ex. 14 | 5/5 | 2000 | 2000 | 90 | 0 |

TABLE 1-3

| No. | Fibrous structure | Polyester content % | Average SP value of disperse dye | Resin finish | Plasma polymerization conditions: Polymerization process | Electrode system | Monomer: Monomer | Monomer: Average SP value | Nonpolymerizable gas | Vacuum Torr | Output W/cm² | Time Sec. | Film thickness Å | XPS analysis data: α | β | A % | B % | C % | D % | E % |
|---|---|---|---|---|---|---|---|---|---|---|---|---|---|---|---|---|---|---|---|---|
| Ex. 15 | Polyester taffeta | 100 | 9.4 | Acrylic coating | Process A | Not grounded | $C_2F_4$ | 3.3 | | 0.3 | 2 | 180 | 2200 | 0.51 | 0.19 | 56 | 13 | 17 | 9 | 5 |
| Ex. 16 | Polyester taffeta | " | " | Acrylic coating | Process A | Not grounded | $C_3F_6O$ | 3.1 | | 0.3 | 2 | 180 | 2300 | 0.51 | 0.25 | 53 | 15 | 16 | 10 | 6 |
| Ex. 17 | Polyester taffeta | " | " | Acrylic coating | Process A | Not grounded | $C_3F_8$ | 2.3 | | 0.3 | 2 | 180 | 800 | 0.30 | 0.29 | 54 | 17 | 18 | 8 | 3 |
| Compar. Ex. 2 | Polyester taffeta | " | " | Acrylic coating | Process A | Not grounded | | | | | | | | | | | | | | |
| Compar. Ex. 3 | Polyester taffeta | " | " | Polyvinyl chloride coating | Process A | Not grounded | | | | | | | | | | | | | | |
| Ex. 18 | Polyester taffeta | " | " | Polyvinyl chloride coating | Process A | Not grounded | $C_4F_8$ | 2.3 | | 0.15 | 1 | 120 | 500 | | | | | | | |
| Compar. Ex. 4 | Polyester taffeta | " | $8.2\left(\frac{83}{81}=V_1\right)$ | Polyurethane coating | Process A | Not grounded | | | | | | | | | | | | | | |
| Ex. 19 | Polyester taffeta | " | " | Polyurethane coating | Process A | Not grounded | $C_2H_4F_2$ | 4.8 | $H_2$ | 0.5 | 1 | 180 | 900 | | | | | | | |
| Ex. 20 | Polyester taffeta | " | " | Polyurethane coating | Process A | Not grounded | $CF_4$ | 2.2 | $H_2$ | 0.5 | 1 | 180 | 600 | 0.87 | 0.24 | 37 | 18 | 21 | 14 | 10 |
| Compar. Ex. 5 | Polyester taffeta | " | " | Polyurethane coating | Process A | Not grounded | $CF_4$ | 2.2 | | 0.5 | 1 | 180 | 0 | | | | | | | |
| Ex. 21 | Polyester taffeta | " | " | Polyurethane coating | Process A | Not grounded | $C_2HClF_2$ | 5.0 | | 0.2 | 0.4 | 180 | 500 | | | | | | | |
| Ex. 22 | Polyester taffeta | " | " | Polyurethane coating | Process A | Not grounded | $C_2Br_2F_4$ | 2.9 | | 0.2 | 0.4 | 180 | 300 | | | | | | | |
| Ex. 23 | Polyester taffeta | " | " | Polyurethane coating | Process A | Not grounded | $CHBrF_2$ | 4.2 | | 0.2 | 0.4 | 180 | 300 | | | | | | | |
| Compar. Ex. 6 | Polyester 40% Cotton 60% | 40 | 9.1 | Polyurethane coating | Process A | Not grounded | | | | | | | | | | | | | | |
| Ex. 24 | Polyester 40% Cotton 60% | " | " | Polyurethane coating | Process A | Not grounded | $C_3F_6O$ | 3.1 | | 0.1 | 0.7 | 180 | 800 | | | | | | | |

TABLE 1-4

| No. | Dye migration and sublimation Dry/Wet | Water vapor permeability $g/m^2/24$ hr | Resistance to hydrostatic pressure mm | Water repellence points | Durability |
|---|---|---|---|---|---|
| Ex. 15 | 5/5 | 2000 | 1900 | 100 | 0 |
| Ex. 16 | 5/5 | 2000 | 2200 | 95 | 0 |
| Ex. 17 | 4-5/4-5 | 2100 | 1300 | 85 | 0 |
| Compar. Ex. 2 | 2-3/2 | 2570 | 670 | 80 | 0 |
| Compar. Ex. 3 | 3/3 | 20 | ≧3000 | 70 | 0 |
| Ex. 18 | 4/4 | 20 | " | 80 | 0 |
| Compar. Ex. 4 | 2/1-2 | 3500 | 2000 | 80 | 0 |
| Ex. 19 | 4/4 | 3300 | 2500 | 85 | 0 |
| Ex. 20 | 3-4/3-4 | 3400 | 2000 | 85 | 0 |
| Compar. Ex. 5 | 2-3/2-3 | 3500 | 2000 | 95 | 0 |
| Ex. 21 | 4/4 | 3400 | 2200 | 80 | 0 |
| Ex. 22 | 3-4/3-4 | 3400 | 2100 | 80 | 0 |
| Ex. 23 | 3-4/3-4 | 3400 | 2100 | 80 | 0 |
| Compar. Ex. 6 | 2-3/2-3 | 2500 | 2000 | 80 | 0 |
| Ex. 24 | 4-5/4-5 | 2400 | 2200 | 85 | 0 |

EXAMPLES AND COMPARATIVE EXAMPLES IN SERIES B

The results given in Table 2 for Comparative Example 1, Examples 1, 2 and 4 and Comparative Example 2 in series B indicate that, in the case of plasma polymerization of $C_2F_4$, film thicknesses of not less than 100 angstroms are satisfactorily effective in preventing dye migration and sublimation. Said results are also indicative of improvements in characteristic properties such as hydrostatic pressure resistance and water repellency.

The results of Examples 2 and 3 indicate that the electrical isolation of the electrodes of the plasma irradiation apparatus from the can body is effective in efficient film formation.

From Examples 5, 6 and 7 and Comparative Example 1, it is seen that the plasma polymerization of TMCS and of VDEMS also produce improvements in the dye migration and sublimation prevention, hydrostatic pressure resistance and water repellency.

In Example 8, active sites were formed on the sheet-like structure surface by Ar gas discharge, followed by introduction of the VDEMS monomer to thereby cause the grafting reaction to proceed on and from the active sites. In Example 9, peroxides were formed on the sheet-like structure surface by $O_2$ gas discharge, followed by introduction of VDEMS while heating the electrode at 80° C. to thereby cause the grafting reaction to proceed. In both Examples 8 and 9, the dye migration and sublimation preventing effect, water resistance and water repellency were good.

In Example 10, methane gas plasma polymerization was effected on an acrylic resin-coated sample. The effect of preventing dye migration and sublimation was better as compared with Comparative Example 3.

In Examples 11, 12 and 13, the plasma polymerization was carried out using different monomer species and thus varying the difference between the average SP value for the disperse dye and the average SP value for the monomer. The use of VTAS, which has an SP value lower by 0.6 than the average SP value for the disperse dye, also resulted in marked improvement in the effect of preventing dye migration and sublimation as compared with Comparative Example 4 although the effect was somewhat less as compared with other monomers, namely VDEMS and $NH_3$ because the SP value of CTAS differs from the minimum SP value of the disperse dye only by 0.1.

In Example 14, the plasma polymerization was carried out on a cotton-PET blend-based sample using a 1:1 gaseous mixture of $C_2F_4$ and $CH_4$. As compared with Comparative Example 5, marked improvements were achieved in the dye migration and sublimation prevention, hydrostatic pressure resistance and water repellency, with no changes in the air permeability and water vapor permeability. The durability was good.

TABLE 2-1

| | | | | | Plasma polymerization conditions | | | | |
|---|---|---|---|---|---|---|---|---|---|
| | | | | | | | Monomer | | |
| No. | Fibrous structure | Polyester content % | Average SP value of disperse dye | Resin finish | Polymerization process | Electrode system | Monomer | Average SP value | Nonpolymerizable gas |
| Comparative Example 1 | PET taffeta, 75 warps/36 wefts | 100 | 9.4 | Polyurethan coating | | | | | |
| Example 1 | PET taffeta, 75 warps/36 wefts | " | " | Polyurethan coating | Process A | Not grounded | $C_2F_4$ 20 cc/min. | 5.2 | — |
| Example 2 | PET taffeta, 75 warps/36 wefts | " | " | Polyurethan coating | " | Not grounded | $C_2F_4$ 20 cc/min. | " | — |
| Example 3 | PET taffeta, 75 warps/36 wefts | " | " | Polyure- | " | Grounded | $C_2F_4$ 20 cc/min. | " | — |

TABLE 2-1-continued

| No. | Fibrous structure | Polyester content % | Average SP value of disperse dye | Resin finish | Plasma polymerization conditions: Polymerization process | Electrode system | Monomer: Monomer | Monomer: Average SP value | Nonpolymerizable gas |
|---|---|---|---|---|---|---|---|---|---|
| | | | | than coating | | | | | |
| Example 4 | PET taffeta, 75 warps/36 wefts | " | " | Polyurethan coating | " | Not grounded | $C_2F_4$ 20 cc/min. | " | — |
| Comparative Example 2 | PET taffeta, 75 warps/36 wefts | " | " | Polyurethan coating | " | Not grounded | $C_2F_4$ 20 cc/min. | " | — |
| Example 5 | PET taffeta, 75 warps/36 wefts | " | " | Polyurethan coating | " | Not grounded | TMCS 20 cc/min. | 4.8 | — |
| Example 6 | PET taffeta, 75 warps/36 wefts | " | " | Polyurethan coating | " | Not grounded | TMCS 10 cc/min. | " | Ar 10 cc/min. |
| Example 7 | PET taffeta, 75 warps/36 wefts | " | " | Polyurethan coating | " | Not grounded | VDEMS 20 cc/min. | 7.2 | — |
| Example 8 | PET taffeta, 75 warps/36 wefts | " | " | Polyurethan coating | Process B | Not grounded | | | Ar 20 cc/min. |

TABLE 2-2

| No. | Plasma polymerization conditions: Vacuum Torr | Output W/cm² | Time Sec. | Monomer: Monomer | Monomer: Average SP | Vacuum Torr | Time Sec. | Film thickness Å |
|---|---|---|---|---|---|---|---|---|
| Comparative Example 1 | | | | | | | | |
| Example 1 | 0.15 | 2 | 180 | | | | | 1000 |
| Example 2 | 0.15 | 1 | 180 | | | | | 850 |
| Example 3 | 0.15 | 1 | 180 | | | | | 400 |
| Example 4 | 0.15 | 1 | 60 | | | | | 300 |
| Comparative Example 2 | 0.15 | 1 | 10 | | | | | 50 |
| Example 5 | 0.3 | 1 | 60 | | | | | 1200 |
| Example 6 | 0.3 | 1 | 60 | | | | | 1000 |
| Example 7 | 0.3 | 2 | 120 | | | | | 3700 |
| Example 8 | 0.15 | 1 | 30 | VDEMS 20 cc/min. | 7.2 | 0.5 | 60 | 2000 |

| No. | Migration and sublimation Dry/Wet | Air permeability cc/cm²/sec | Water vapor permeability g/m²/24 hr | Resistance to hydrostatic pressure mm/cm² | Water repellency points | Durability |
|---|---|---|---|---|---|---|
| Comparative Example 1 | 2-3/2 | 0.2 | 4700 | 500 | 80 | 0 |
| Example 1 | 5/5 | 0.2 | 4700 | 1200 | 100 | 0 |
| Example 2 | 5/5 | 0.2 | 4700 | 1200 | 100 | 0 |
| Example 3 | 5/5 | 0.2 | 4700 | 1000 | 100 | 0 |
| Example 4 | 5/5 | 0.2 | 4700 | 1000 | 100 | 0 |
| Comparative Example 2 | 4/4 | 0.2 | 4700 | 700 | 90 | 0 |
| Example 5 | 5/5 | 0.2 | 4700 | 1300 | 100 | 0 |
| Example 6 | 5/5 | 0.2 | 4700 | 1300 | 100 | 0 |
| Example 7 | 5/5 | 0.2 | 4700 | 1300 | 100 | 0 |
| Example 8 | 5/5 | 0.2 | 4700 | 1300 | 100 | 0 |

TABLE 2-3

| No. | Fibrous structure | Polyester content % | Average SP value of disperse dye | Resin finish | Plasma polymerization conditions: Polymerization process | Electrode system | Monomer: Monomer | Monomer: Average SP value | Nonpolymerizable gas |
|---|---|---|---|---|---|---|---|---|---|
| Exam- | PET | 100 | 9.4 | Polyurethan | Process C | Not | | | $O_2$ |

TABLE 2-3-continued

| No. | Fibrous structure | Polyester content % | Average SP value of disperse dye | Resin finish | Plasma polymerization conditions: Polymerization process | Electrode system | Monomer: Monomer | Monomer: Average SP value | Nonpolymerizable gas |
|---|---|---|---|---|---|---|---|---|---|
| ple 9 | taffeta, 75 warps/ 36 wefts | | | coating | | grounded | | | 20 cc/min. |
| Example 10 | PET taffeta, 75 warps/ 36 wefts | " | " | Acrylic coating | Process A | Not grounded | $CH_4$ 20 cc/min. | 5.4 | |
| Comparative Example 3 | PET taffeta, 75 warps/ 36 wefts | " | " | | | | | | |
| Example 11 | PET taffeta, 75 warps/ 36 wefts | " | $8.8\left(\frac{8.3}{9.3} = 1/1\right)$ | Polyurethane coating | " | Not grounded | VTAS 20 cc/min. | 8.2 | |
| Example 12 | PET taffeta, 75 warps/ 36 wefts | " | " | Polyurethane coating | " | Not grounded | VDEMS 20 cc/min. | 7.2 | |
| Example 13 | PET taffeta, 75 warps/ 36 wefts | " | " | Polyurethane coating | " | Not grounded | $NH_3$ 30 cc/min. | 16.3 | |
| Comparative Example 4 | PET taffeta, 75 warps/ 36 wefts | " | " | | | | | | |
| Comparative Example 5 | Cotton-PET blended yarn knit | 40 | 9.3 | Polyvinyl chloride | | | | | |
| Example 14 | Cotton-PET blended yarn knit | " | " | Polyvinyl chloride | " | Not grounded | $C_2F_4$ 10 cc/min. $CH_4$ 10 cc/min. | $5.3\left(\frac{5.2}{5.4} = 1/1\right)$ | |

TABLE 2-4

| No. | Plasma polymerization conditions: Vacuum Torr | Output W/cm² | Time Sec. | Monomer: Monomer | Monomer: Average SP | Vacuum Torr | Time Sec. | Film thickness Å |
|---|---|---|---|---|---|---|---|---|
| Example 9 | 0.15 | 1 | 10 | VDEMS 10 cc/min. Ar 10 cc/min. | 7.2 | 0.5 | 60 | 1000 |
| Example 10 | 0.5 | 1 | 120 | | | | | 200 |
| Comparative Example 3 | | | | | | | | |
| Example 11 | 0.3 | 2 | 60 | | | | | 1500 |
| Example 12 | 0.3 | 2 | 60 | | | | | 1500 |
| Example 13 | 0.5 | 1 | 180 | | | | | 200 |
| Comparative Example 4 | | | | | | | | |
| Comparative Example 5 | | | | | | | | |
| Example 14 | 0.3 | 1 | 60 | | | | | 250 |

| No. | Migration and sublimation Dry/Wet | Air permeability cc/cm²/sec | Water vapor permeability g/m²/24 hr | Resistance to hydrostatic pressure mm/cm² | Water repellency points | Durability |
|---|---|---|---|---|---|---|
| Example 9 | 5/5 | 0.2 | 4700 | 1300 | 100 | 0 |
| Example 10 | 4-5/4-5 | 0.2 | 2600 | 700 | 90 | 0 |
| Comparative | 2-3/2 | 0.2 | 2600 | 500 | 70 | 0 |

TABLE 2-4-continued

| | | | | | | |
|---|---|---|---|---|---|---|
| Example 3 | | | | | | |
| Example 11 | 4-5/4-5 | 0.2 | 4700 | 1300 | 100 | 0 |
| Example 12 | 5/5 | 0.2 | 4700 | 1300 | 100 | 0 |
| Example 13 | 5/5 | 0.2 | 4700 | 700 | 80 | 0 |
| Comparative Example 4 | 2-3/2-3 | 0.2 | 4700 | 500 | 80 | 0 |
| Comparative Example 5 | 3/3 | 0.5 | 1000 | 500 | 80 | 0 |
| Example 14 | 5/5 | 0.5 | 1000 | 1000 | 100 | 0 |

What is claimed is:

1. A sheet-like structure exhibiting excellent resistance to disperse dye migration and sublimation, said structure comprising a fibrous structure containing not less than 10 weight percent of disperse dye-polyester fiber and having, on at least one side thereof, a resin layer comprising a polymer selected from the group consisting of polyurethane, acrylic polymers, vinyl chloride polymers and synthetic rubbers, with a thin polymer film layer comprising a derivative of a fluorine compound or a silicon-containing compound formed on at least one side of said resin layer, said polymer film layer having a thickness of 100–10,000 angstroms.

2. The sheet-like structure of claim 1, wherein the thin polymer film layer is derivative of a fluorine compound, the degree of fluorination of said thin film layer, $\alpha=F/C$, being within the range of $0.2 \leqq \alpha \leqq 1.8$, said degree of fluorination, $\alpha$, being defined as the quotient resulting from the division of the number of fluorine atoms as calculated from the fluorine $F_{1S}$ peak area measured by X-ray photoelectron spectroscopy by the number of carbon $C_{1S}$ atoms as calculated in the same manner.

3. The sheet-like structure of claim 1, wherein the thin polymer layer is made from a fluorine compound, the degree of fluorination, $\alpha=F/C$, of said thin film layer being within the range of $0.2 \leqq \alpha \leqq 1.3$ and the degree of oxygenation, $\beta=O/C$, being within the range of $0.05 \leqq \beta \leqq 0.35$, said degree of oxygenation, $\beta$, being defined as the quotient resulting from the division of the number of oxygen atoms calculated from the oxygen $O_{1S}$ peak area measured by X-ray photoelectron spectroscopy by the number of carbon $C_{1S}$ atoms as calculated in the same manner.

4. The sheet-like structure of claim 1, wherein the thin polymer film layer meets the conditions $10\% < A < 70\%$, $10\% < B < 35\%$, $10\% < C < 35\%$, $5\% < D < 30\%$ and $0\% < E < 20\%$, A, B, C, D and E being the percentage values derived by performing a procedure of separating the carbon $C_{1S}$ chart obtained by X-ray photoelectron spectroscopic analysis of the thin film layer into several wave forms each centering around a bond energy corresponding to a peak on said chart (wave-form separation procedure), dividing the areas of said wave forms by the total $C_{1S}$ area and multiplying the values thus obtained by 100, A being such percentage value for the wave form having a peak around 285 electron volts (eV), B for the wave form having a peak around $287 \pm 0.5$ eV, C for the wave form having a peak around $289 \pm 0.5$ eV, D for the wave form having a peak around $291.6 \pm 0.5$ eV and E for the wave form having a peak around $293.8 \pm 0.5$ eV.

5. The sheet-like structure of claim 1, wherein the thin polymer film layer meets the conditions $(B+8)\% > (C+3)\% > D\% > E\%$ and $B\% > (E+6)\%$.

6. The sheet-like structure of claim 1, wherein the thin polymer film layer is derivative of a silicon-containing compound.

* * * * *